United States Patent [19]

DeLorean

[11] Patent Number: 4,834,316

[45] Date of Patent: May 30, 1989

[54] AUXILIARY BATHROOM TISSUE DISPENSER

[76] Inventor: Ruth M. DeLorean, 8249 Kennedy Cir. #2, Warren, Mich. 48093

[21] Appl. No.: 232,864

[22] Filed: Aug. 16, 1988

[51] Int. Cl.[4] ..... B65H 16/02; B65H 16/06

[52] U.S. Cl. ..... 242/55.3; 242/55.53

[58] Field of Search ..... 242/55.2, 55.3, 55.53, 242/55.55; 239/52; 206/389, 390, 391, 206, 205; D6/518, 519, 520, 524

[56] References Cited

U.S. PATENT DOCUMENTS

| | | | |
|---|---|---|---|
| 1,552,082 | 9/1925 | Riley | 239/52 |
| 2,025,732 | 12/1935 | Dodelin | 242/55.3 |
| 2,790,608 | 4/1957 | Sieven | 242/55.3 |
| 2,869,871 | 1/1959 | Mitchell | 272/49 X |
| 3,297,265 | 1/1967 | Turro | 242/129.5 |
| 3,824,953 | 7/1974 | Boone | 242/55.3 X |
| 3,837,595 | 9/1974 | Boone | 242/55.53 X |
| 4,235,333 | 11/1980 | Boone | 242/55.53 X |
| 4,385,733 | 5/1983 | O'Keefe | 242/55.3 |
| 4,427,159 | 1/1984 | Miller et al. | 242/55.53 X |
| 4,565,336 | 1/1986 | Hefty et al. | 242/55.55 |

*Primary Examiner*—Stuart S. Levy
*Assistant Examiner*—John M. Eghtessad
*Attorney, Agent, or Firm*—Peter D. Keefe

[57] ABSTRACT

An auxiliary bathroom tissue dispenser incorporating structural provisions for a deodorizer and a wet tissue dispenser. A pair of support brackets hook over a conventional pre-existing primary bathroom tissue roll trunnion. A container having a plurality of air passable openings connects with the support brackets for holding replaceable deodorant tablets. A platform located at the top of the container is structured for holding a conventional wet tissue dispenser. A pair of resilient dispenser brackets depend below the container for holding an auxiliary bathroom tissue roll via a nib on each dispenser bracket, the nibs mating with the center tube of the auxiliary bathroom tissue roll.

5 Claims, 1 Drawing Sheet

AUXILIARY BATHROOM TISSUE DISPENSER

BACKGROUND OF THE INVENTION

1. Field of the Invention

The present invention relates to bathroom paper dispenser units, and more particularly to an auxiliary bathroom tissue dispenser having provision for deodorization and wet tissue dispensing.

2. Description of the Prior Art

It is well known in the prior art to provide bathroom tissue dispensing from a singular dispenser unit which attaches to the bathroom wall. It is also well known in the prior art to provide an auxiliary toilet tissue dispenser that dependingly attaches to the singular permanent tissue dispenser commonly found in the bathroom of residences and businesses. Examples of such devices are as follows. U.S. Pat. No. 2,025,732 to Dodelin discloses a secondary toilet tissue dispenser which depends from the wall. U.S. Pat. No. 2,790,608 to Sieven discloses an auxiliary toilet tissue dispenser which depends from a primary tissue dispenser via curved hooks. Curved brackets enable the auxiliary dispenser to hold an auxiliary tissue roll when the primary tissue roll is located in a recess in the wall. U.S. Pat. No. 2,869,871 to Woodruff discloses a storage receptacle and dispensing holder for bathroom tissues. U.S. Pat. No. 3,297,265 to Turro discloses a two piece auxiliary tissue paper dispenser having hooks for connecting with the primary bathroom tissue dispenser. U.S. Pat. No. 3,824,953 to Boone discloses an auxiliary wet tissue dispenser to be used in conjunction with a conventional dry tissue dispenser. U.S. Pat. No. 4,385,733 to O'Keefe discloses a bracket which depends from a primary bathroom tissue dispenser for holding an extra bathroom tissue roll.

It is also well known that the bathroom is a place in which odors readily accumulate with each use of the toilet. Further, it is also a well known fact that adequate hygiene is frequently not achieved by the singular use of dry bathroom tissues alone. Accordingly, what is needed is to provide a bathroom tissue dispenser bracket which attaches to a conventional bathroom tissue dispenser in order to thereby provide the features of an auxiliary bathroom tissue roll, deodorization of the bathroom and wet tissue dispensing.

SUMMARY OF THE INVENTION

The present invention is an auxiliary bathroom tissue dispenser which incorporates the additional features of deodorization and wet tissue dispensing.

Two support brackets are provided which have hooked portions for hooking over a conventional bathroom tissue roll holder trunnion. Connected with the two support brackets is a container for holding conventional deodorant tablets. The container has a plurality of openings around its perimeter for allowing bathroom air to mix with the deodorant vapors being released from the deodorant tablets therewithin. At the top of the deodorant container is a platform for holding a conventional wet tissue dispenser. Two dispenser brackets depend from beneath the deodorant container for holding an auxiliary bathroom tissue roll.

Accordingly, it is an object of the present invention to provide an auxiliary bathroom tissue dispenser which releasably attaches to a primary bathroom tissue dispenser.

It is an additional object of the present invention to provide an auxiliary bathroom tissue dispenser which provides deodorization for the bathroom.

It is a further object of the present invention to provide an auxiliary bathroom tissue dispenser which provides for wet tissue dispensing.

These and additional objects, features and advantages of the present invention will become apparent from reading of the following specification.

DETAILED DESCRIPTION OF THE PREFERRED EMBODIMENT

Figure 1:
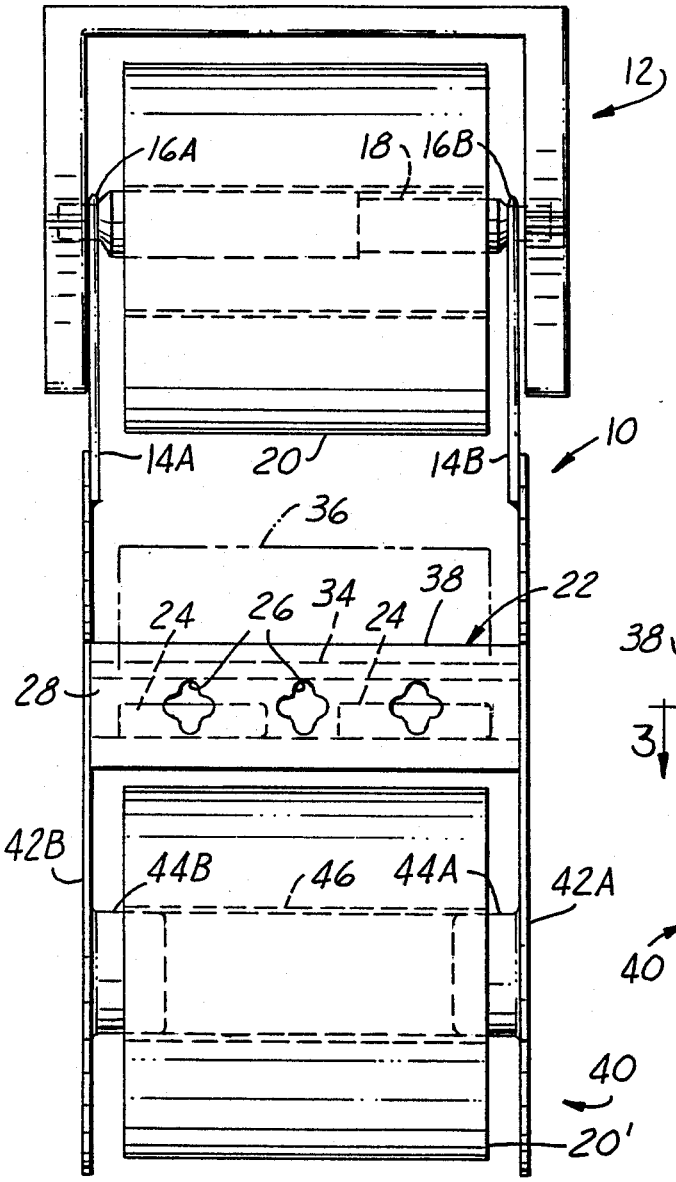
FIG. 1 is a frontal view of the bathroom tissue dispenser according to the present invention.
Figure 2:
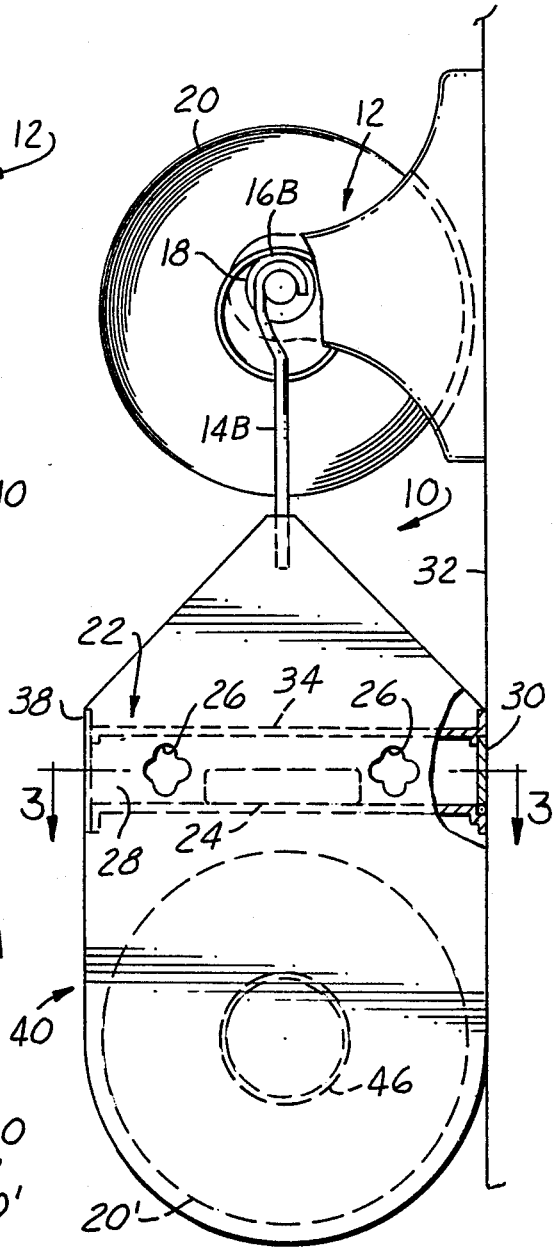
FIG. 2 is a side view of the bathroom tissue dispenser of FIG. 1.
Figure 3:
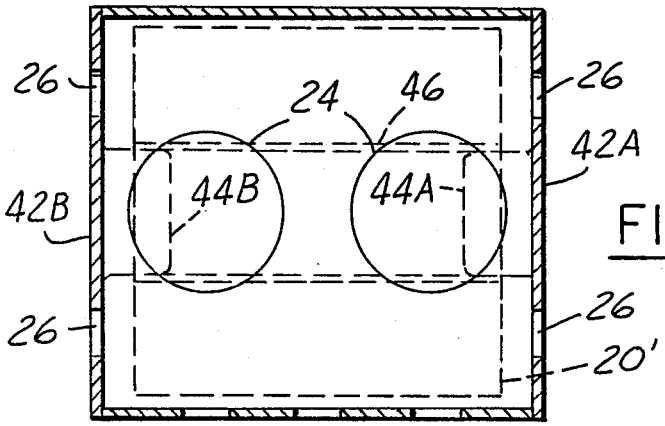
FIG. 3 is a part sectional plan view of the bathroom tissue dispenser of FIG. 1 seen along lines 3—3 of FIG. 2.

Referring now to the figures, FIGS. 1 and 2 shown the auxiliary bathroom tissue dispenser 10 according to the present invention. The auxiliary bathroom tissue dispenser is releasably hooked onto a primary bathroom tissue dispenser 12 of conventional structure. Two support brackets 14A and 14B are provided, each ending in a hooked portion 16A and 16B, respectively, These hooked portions are structured to rest over the trunnion 18 of the primary bathroom tissue dispenser 12. As can be seen from FIG. 1, the support brackets 14A and 14B are spaced apart so that the hooked portions hook over the trunnion 18 on either side of a conventional bathroom tissue roll 20.

The auxiliary bathroom tissue dispenser 10 includes a container 22 for holding at least one conventional deodorant device, such as a deodorant tablet 24. The container 22 is connected to and between the support brackets 14A and 14B, and is enclosed on all sides except for a plurality of decorative openings 26 along the sidewalls 28 of the container 22. The height of the container 22 is sufficient to allow conventional deodorant tablets to be easily inserted thereinto, typically on the order of one to two inches. A rear door 30 is provided in the container 22 so that children cannot accidentally gain access to the deodorant tablets 24 therein contained. The rear door is preferred to have a snap fit onto the container sidewalls, but may be hinged thereonto as well. It can be seen from FIG. 2 that the rear door 30 will ordinarily rest against the bathroom wall 32, thereby affording stability to the auxiliary bathroom tissue dispenser 10.

The auxiliary bathroom dispenser 10 further includes a platform 34 on which to rest a conventional wet tissue dispenser 36. It is preferred that the platform 34 be integral with the container 22. It is further preferred that a lip 38 be provided around the edges of the platform 34 so that the wet tissue dispenser will be restrained to remain located on the platform during use.

The auxiliary bathroom tissue dispenser 10 further includes an auxiliary bathroom tissue dispenser 40. Two dispenser brackets 42A and 42B are provided which depend downwardly from the container 22. It is preferred that the dispenser brackets 42A and 42B be made of resilient material and that each have, respectively, a nib 44A and 44B structured for mating with the center tube 46 of a conventional bathroom tissue roll 20' after the nibs have been spread apart to allow placement of the center tube on the nibs. However, it is alternatively possible to provide notches in the dispenser brackets for receiving a trunnion 18, in the manner indicated for the primary bathroom tissue dispenser 12. As can be seen from FIGS. 1 and 2, the dispenser brackets 42A and 42B are preferred to connect directly with the support brackets 14A and 14B, the dispenser brackets forming a part of the sidewalls of the container 22. The support brackets and dispenser brackets may be connected by any convenient means, such as by sonic welding or gluing.

It is preferred that the auxiliary bathroom tissue dispenser be made of a structurally strong and decorative plastic materials.

In operation, the rear door is opened and at least one deodorant tablet is placed therein and the rear door closed. The hooked portions of the support brackets are then placed over the trunnion of the pre-existing primary bathroom tissue dispenser, and are then allowed to rest thereon. Next, a wet tissue dispenser is placed on the platform. Finally, the dispenser brackets are mutually separated slightly to allow a bathroom tissue roll to be placed on the nibs, then the dispenser brackets are released, permitting them to resiliently return to their original shape, the nibs now mating with the center tube of the bathroom tissue roll.

To those skilled in the art to which this invention appertains, the above described preferred embodiment may be subject to change or modification. Such change or modifications can be carried out without departing from the scope of the invention, which is intended to be limited only by the scope of the appended claims.

What is claimed is:

1. An auxiliary bathroom tissue dispenser for being releasably attached to a primary bathroom tissue dispenser, said auxiliary bathroom tissue dispenser comprising:

a pair of support brackets, each said support bracket having at one end a hook;

a pair of dispenser brackets for holding an auxiliary bathroom tissue roll, said pair of dispenser brackets being connected with said pair of support brackets, one said support bracket being connected with one said dispenser bracket;

a container connected with one of said pair of dispenser brackets and said support brackets, said container having a plurality of air passable openings, said container further having a selectively coverable opening for permitting at least one deodorant device to be placed into said container;

a platform for supporting at least one wet tissue dispenser, said platform being integrally connected with said container; and holding means on said dispenser brackets for releasably holding an auxiliary bathroom tissue roll between each dispenser bracket of said pair of dispenser brackets.

2. The auxiliary bathroom tissue dispenser of claim 1, wherein said deodorant device is a deodorant tablet.

3. The auxiliary bathroom tissue dispenser of claim 2, wherein said platform has edges, further wherein said platform has a lip along said edges for keeping said wet tissue dispenser located on said platform when said wet tissue dispenser is in use.

4. The auxiliary bathroom tissue dispenser of claim 3, wherein said each said hook is structured to hook over a trunnion of said primary bathroom tissue dispenser.

5. The auxiliary bathroom tissue dispenser of claim 4, wherein said bracket means form a part of said container.

* * * * *